US005411211A

United States Patent [19]

Greene et al.

[11] Patent Number: 5,411,211

[45] Date of Patent: May 2, 1995

[54] SPRAY GUN

[76] Inventors: Robert H. Greene, Westfield, 5 Prospect Villas, Wetherby, Leeds LS22 4PL, United Kingdom; Alan C. Outhwaite, 1 Cobbler Hall, West Bretton, Wakefield WF4 4LJ, United Kingdom; Timothy J. Noakes, The Hollies, Llyn-y-Pandy Lane, Pantymwyn, Near Mold, Clwyd CH7 5JF, Wales, United Kingdom; Michael L. Green, 2 Tai-cochion, Village Road, Nannerch, Clwyd CH7 5RE, Wales, United Kingdom; Jonathan Jones, c/o Apex Product Design, 4 Crinan Street, Kings Cross, London, United Kingdom

[21] Appl. No.: 193,185

[22] PCT Filed: Aug. 12, 1992

[86] PCT No.: PCT/GB92/01490

§ 371 Date: May 25, 1994

§ 102(e) Date: May 25, 1994

[87] PCT Pub. No.: WO93/03853

PCT Pub. Date: Mar. 4, 1993

[30] Foreign Application Priority Data

Aug. 13, 1991 [GB] United Kingdom ..... 9117462
Jun. 18, 1992 [GB] United Kingdom ..... 9212974

[51] Int. Cl.[6] ..... B05B 11/02; B05B 5/16

[52] U.S. Cl. ..... 239/708; 239/321; 239/327; 239/375; 222/391

[58] Field of Search ..... 239/690, 708, 321, 320, 239/327, 375; 222/386, 391, 105

[56] References Cited

U.S. PATENT DOCUMENTS

| | | | |
|---|---|---|---|
| 3,554,450 | 1/1971 | Muhula | 239/424 X |
| 3,563,258 | 2/1971 | Hechler, IV . | |
| 4,549,243 | 10/1985 | Owen et al. . | |
| 5,221,050 | 6/1993 | Jeffries et al. | 239/708 |
| 5,320,291 | 6/1994 | Glooer et al. | 239/708 |

FOREIGN PATENT DOCUMENTS

| | | | |
|---|---|---|---|
| 0482814 | 10/1984 | European Pat. Off. . | |
| 163389 | 12/1985 | European Pat. Off. | 239/690 |
| 92/12798 | 8/1992 | WIPO . | |

*Primary Examiner*—Andres Kashnikow
*Assistant Examiner*—Kevin Weldon
*Attorney, Agent, or Firm*—Larson and Taylor

[57] ABSTRACT

An electrostatic spray gun includes a housing for receiving a replaceable fluid container, a nozzle from which fluid is to be sprayed, a device for expelling fluid from the container, and a high voltage generator for applying electrostatic potential to the fluid to form an electrically charged atomized spray at the nozzle. An electrical path from the generator to the nozzle passes through the fluid, entering the fluid prior to its emergence from the nozzle. The container is rigid and fluid is expelled from the container by a piston under pressure exerted thereon through a forward part of the generator.

10 Claims, 5 Drawing Sheets

SPRAY GUN

The invention relates to electrostatic spray guns.

Many patents have been published on such guns, and further our previous patent application No. 9101812.7 (now PCT GB 92/00156 filed 25 Jan. 1992) relates to them. In our prior spray guns, however, the electrical forces have been applied to the fluid to be sprayed after its emergence from a container.

In current work, we have found the fluid may itself be part of the electrical path. Suitable fluids such as paints then appear to behave as if charged electrostatically, leading to generation of a cloud of separated charged droplets as soon as the paint issues from a nozzle. Then, with a suitably earthed target, the droplets are attracted and discharged electrically, to form a coating.

The invention thus provides an electrostatic spray gun comprising a housing for receiving a replaceable fluid container, a nozzle from which fluid is to be sprayed, means for expelling fluid from the container, and a high voltage generator for applying electrostatic potential to the fluid to form an electrically charged atomised spray at the nozzle, wherein the container is externally insulating and the electrical path from the generator passes through the fluid, entering it at a point remote from the nozzle.

The invention also provides an electrostatic spray gun comprising a housing for receiving a replaceable fluid container, a nozzle from which fluid is to be sprayed, means for expelling fluid from the container, preferably by mechanical pressure applied thereto, and a high voltage generator for applying electrostatic potential to the fluid to form an electrically charged atomised spray at the nozzle, wherein the electrical path from the generator to the nozzle passes through the fluid, entering the fluid prior to its emergence from the nozzle, conveniently via the wall of the container.

In a simple and convenient construction, in operation the container is drawn back towards the generator to commence spraying, the movement opening a valve for passage of fluid from the nozzle.

Use of such constructions allows very easy front loading of a container and its valve into a gun, or alternatively if required attachment of a complete disposable container/nozzle unit, dispensing with the need for complex conductive paths, without difficulty in securing proper electrical connections. Further where the container is externally insulating there is no risk of shock. Even if the gun is misused, with loading attempted with the generator on, the container cannot discharge the gun through the operator. A range of different units may be provided for a given gun. Specifically for example front loading of the container into the gun simultaneously makes connection to the electrical path from the generator or places the container in a position where a short further movement opening a valve for passage of fluid from the nozzle also makes such contact.

Electrical connection is conveniently made centrally of the rear of the container, passing through its wall for contact with the contents, but various constructions are suitable.

In one construction the container is at least in substantial part of flexible insulating material and the gun has means for compressing the container to feed fluid to the nozzle, the generator applying the potential to the fluid through a conductive connection in an insulating part of the container wall. It may then be convenient for the electrical connection to close an aperture in the container through which the container is filled. In such cases "flexible" implies that at least a substantial part of a fluid-containing portion of the container is flexible walled, not that the container is flexible walled throughout though such a construction is convenient.

Alternatively the container may be of rigid insulating material, fluid being expelled by a piston under pressure exerted on it by a forward part of the generator or otherwise. Electrical connection may then be through the piston, of conducting material or at least having an electrical connection through it to the fluid. Alternatively again the container, while externally insulating, may be of metal, making the required electrical connection with the generator interiorly, at a position remote from the nozzle, and providing a direct electrical path to the fluid within the container interior.

In the following detailed description of an example of a gun according to the invention a number of generally applicable features are discussed. In particular, in passing the fluid to the nozzle, it is desirable that alternative flow rates should be available. Conveniently for the purpose pressure is applied to the fluid by a handgrip through the intermediary of a variably pretensionable spring, the force necessary to overcome the pretension determining the minimum force that has to be exerted to actuate the handgrip and thus the minimum pressure applied to the fluid. No variability in the nozzle is then necessary and a simple on/off valve as in aerosols can be used.

Alternatively it may be sufficient that pressure is exerted directly on the container via levers from a hand operated trigger.

The invention is illustrated in the accompanying drawings of embodiments wherein.

Figure 1:
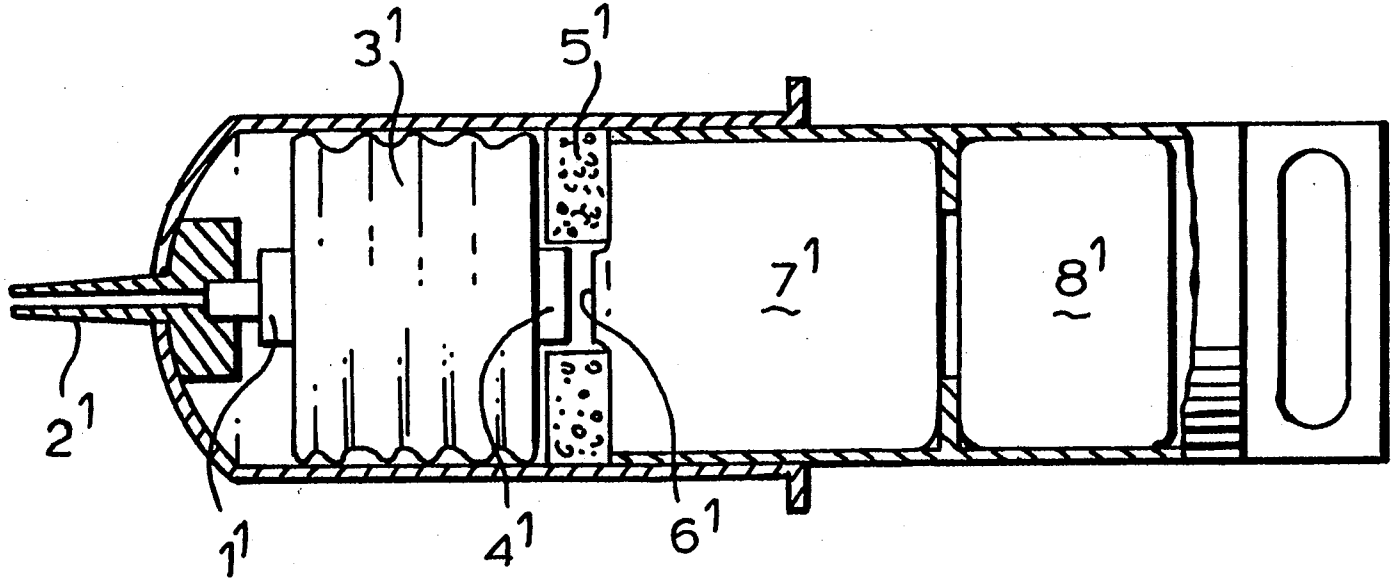
FIG. 1 shows a diagrammatic section of a simple plunger-style gun with a flexible container.

In use of the gun of FIG. 1 the container 3' is drawn backwards into a stationary generator 7' and battery 8'. The force applied to draw back the container, by a simple telescopic hand action, serves to open a spring loaded valve 1' and compress the container in order to expel the contents under a flow controlled by the nozzle 2'. At the same time contact is made between a conductive button 4' situated in the base of the container and an H T terminal 6' on the generator, a resilient foam collar 5', or a spring, ensuring that they separate again on release.

Figure 2:
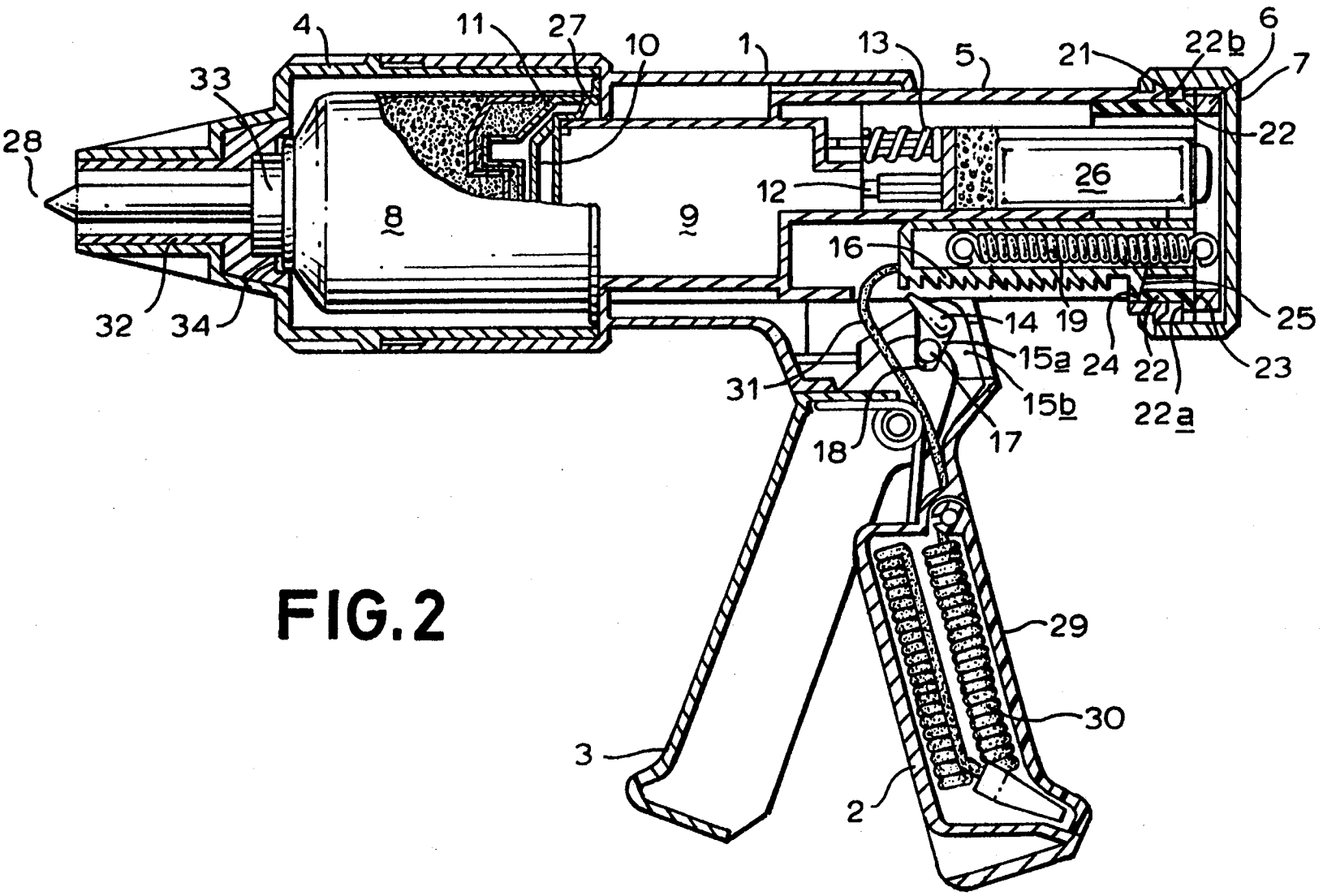
FIG. 2 shows a trigger operated piston-container gun, in detailed part-sectional elevation.
Figure 3:
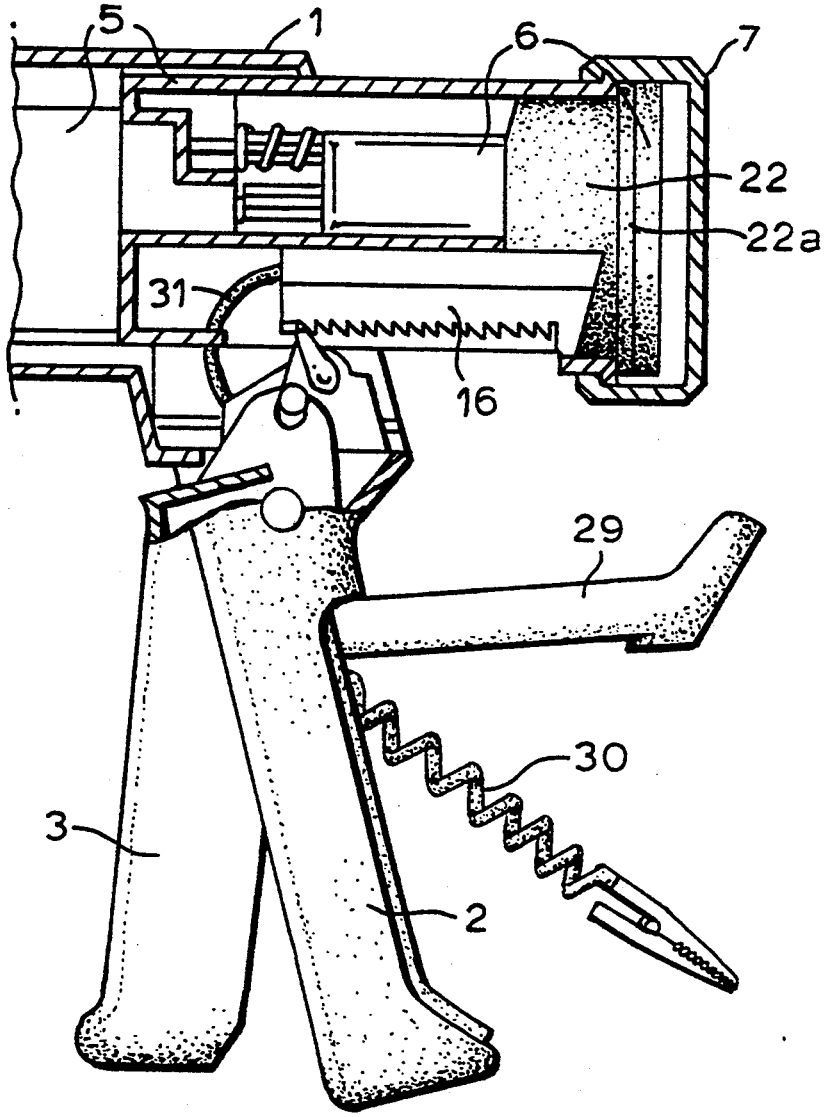
FIG. 3 shows part of the gun of FIG. 2 at the point of operation at which a generator switch has been closed but no paint delivery pressure has been applied.
Figure 4:
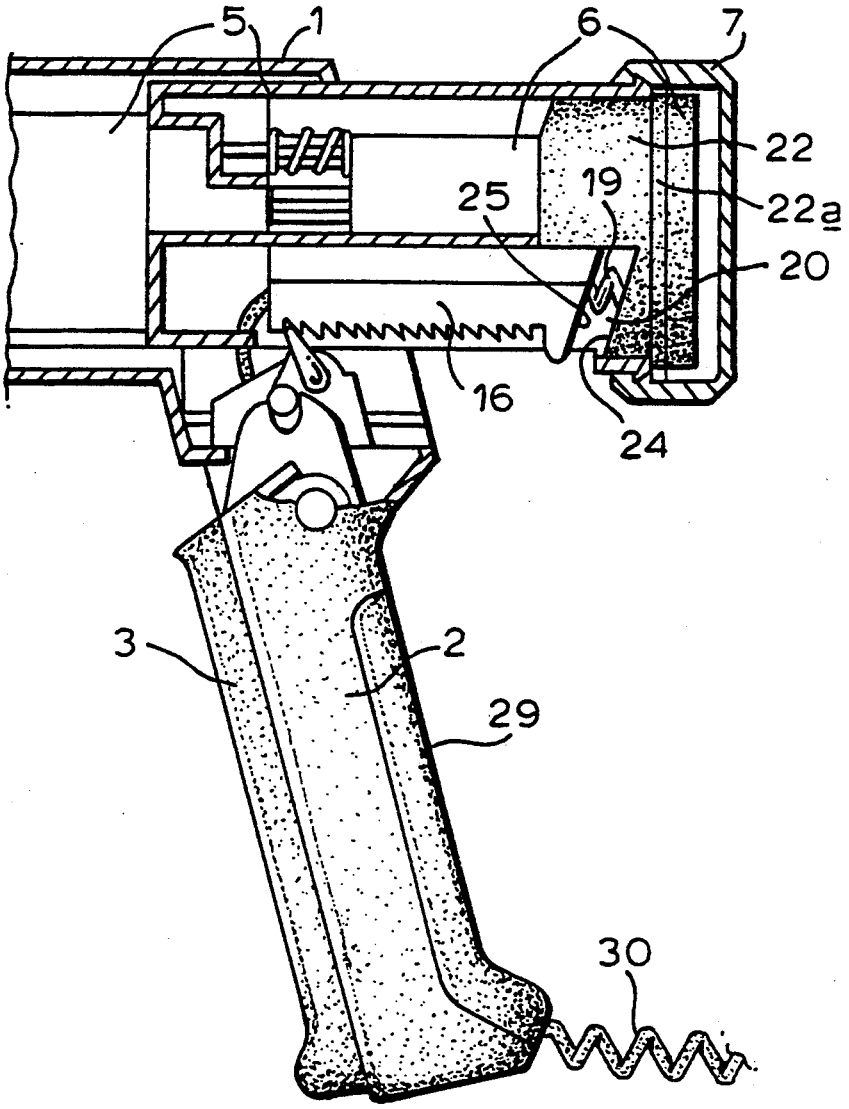
FIG. 4 shows the paint delivery position for the same gun.
Figure 5:
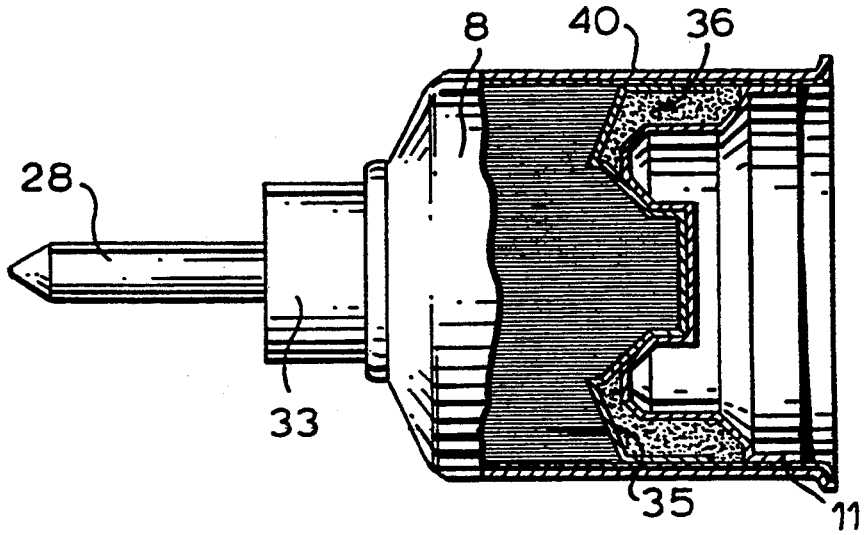
FIG. 5 shows a paint container for use with a gun such as that of FIGS. 2–4 in part sectional elevation, (though not corresponding exactly to the container shown in the other drawings)
Figure 6:
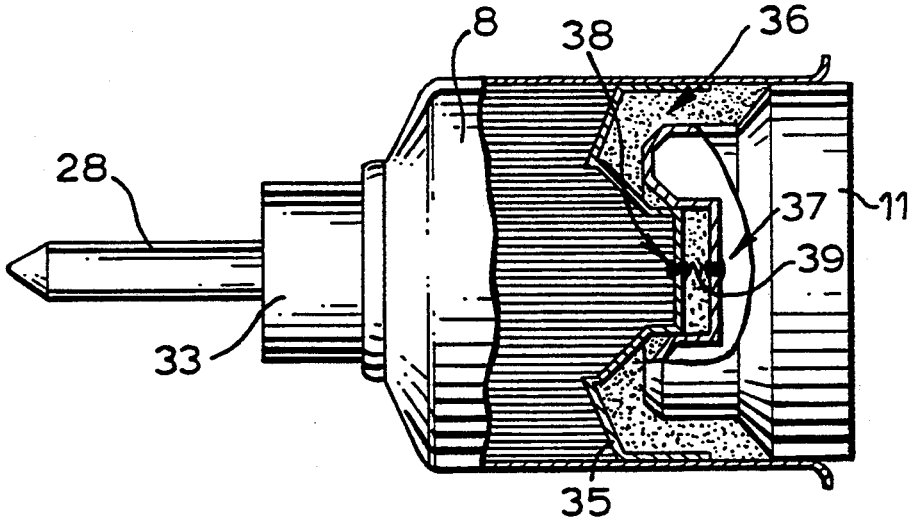
FIG. 6 shows an alternative container.

The following description is of the gun of FIGS. 2–4 and with reference to the containers of FIGS. 5 and 6.

The main parts of the gun are largely moulded in polypropylene and include a main body 1 with integral handle 2 and a trigger 3. The body carries a front cap 4; a generator housing 5; a battery holder 6; and a rear cap 7. The body and front cap together define a housing for a paint container 8. The generator housing slides within the body, urged forward on squeezing of the trigger, and besides accommodating the generator 9 carries a nose 10 to bear on an outer piston 11 within the paint container to expel the paint.

The battery holder in turn slides within the generator housing, but only over a short travel necessary to close a generator switch 12; it is under the control of a return spring 13 that as soon as the trigger is released re-opens the switch.

The operating connection between the trigger and the battery holder and thus the generator housing is through a pawl 14 and ratchet 16. When the trigger is closed the pawl, which is mounted on a small rotatable carrier 15*a* itself mounted on a slide 15*b*, is first moved into engagement with the ratchet by rotation of its carrier by a pin 17 engaged in a slot 18 formed in the end of the trigger. Further movement of the trigger then slides the ratchet and pawl together and extends a regulating spring 19 disposed between and operatively connecting the ratchet and the battery holder. The force needed to do this depends on the setting of the regulating spring as described below, and provides for a variable paint delivery pressure. Paint is then delivered until the work is done and the trigger is released, or until the gap 20 (FIG. 3) opened between the ratchet and battery carrier has closed, when the trigger may be released and a fresh advance of the ratchet made to continue delivery.

The setting of the regulating spring, which has a small pretension in any event, is effecting by the rear cap 7. The cap is rotatable and snaps onto the generator housing over a retaining ridge 21 (it is removable for battery replacement). The cap retains, within the generator housing and as a unit slidable over the short travel necessary to open and close the generator switch, first the battery carrier 6, secondly the ratchet 16 and thirdly, sandwiched between them under the tension of the regulating spring 19, an adjusting "helicoil" 22. The helicoil has a lip 22*a* disposed to engage with a rear face 22*b* on the generator housing, the gap between them representing the travel between the open and closed positions of the generator switch. To provide for the setting of the regulating spring the helicoil engages the cap by lugs (not shown), so that cap and helicoil turn together but relative axial movement over the required travel is possible. At its plane rear face 23 the helicoil engages part of the battery holder 6, a further part of the holder extending forward within the helicoil to hold the batteries 26. At its helical front face 24 the helicoil engages a sloping face 25 on the ratchet 16. As the regulating spring 19 is disposed between the ratchet and the battery holder, rotation of the cap 7 and with it the helicoil 22 varies the tension of the spring. Clockwise rotation of the cap (as seen from the rear of the gun) drives the ratchet forward to increase the pretension and thus the minimum trigger pressure needed to draw the ratchet further forward commence paint delivery. Anti-clockwise rotation allows the regulating spring to draw the ratchet back as the interposed part of the helicoil narrows, to reduce the pretension again.

Electrically, the gun uses conventional dry batteries 26 and per se known 17 or 34 Kv generator 9. When the switch 12 is in the closed position the electrical path is from the generator through a spring contact 27 to an aluminium container 8, desirably externally insulatingly coated, thence through the paint itself to the nozzle tip 28 (the nozzle is of insulating plastics) where the electrical force applied breaks up the paint into a spray of charged droplets in per se known manner. The spray droplets, controlled in their distribution by a field generated by a urea-based resin shroud 32 in electrical contact with the paint container, travel to the work and discharge to earth. The circuit is completed, according to conditions, either from earth through the operator's hand and the gun structure, the handle of the gun being made, as to a cover 29, from carbon filled plastics, or through an earth lead 30 housed in the handle for attachment to the work (the cover 29 then being closed again) and providing a path back to the generator through an internal lead 31, running in a shrouded path (not shown). The current carried is minute and harmless, and of course access to the electrode 27 during spraying, with a sudden discharge of the generator, is impossible. So likewise, is access during loading, even if tried with the trigger closed.

The paint container 8 has a simple aerosol-type on/-off valve 33 which is opened, when the generator nose 10 engages the outer piston 11, by the container moving forward to close a gap 34 between the container body 8 and the shroud 32. Paint passes up the nozzle to emerge at the nozzle tip 28 and form the spray.

The container itself, as already noted, is of aluminium, desirably, externally insulated, and the valve body and nozzle are of insulating plastics. The electrical path is thus through the paint, and electrical connection for spraying is provided simply by the loading of the container, already inserted in the front cap 4, into the gun body 1, the electrode 27 engaging the interior of the open rear end of the container. Within the container, as best seen in FIG. 4, are the outer piston 11 previously mentioned and an inner piston 35, both in this example of plastics though they may equally be of metal, a liquid lubricant seal 36 being provided between them. The lubricant, immiscible with the paint, ensures even paint delivery, no excess force being needed to start delivery from a new container or restart it from a partly used one, though if desired, to be sure of the absence of sticking, the piston can be rotated over a short arc within the container in the course of loading. In preparing the container the inner piston is inserted, then the lubricant, then the outer piston. The pistons are pushed down together far enough to ensure that there is lubricant between them and the container walls, and then withdrawn to the position shown. Paint is then filled into the container and the valve and nozzle attached.

The container, spring contact 27 and inner and outer pistons shown in FIGS. 2–5 have as an alternative the use of a container such as that of FIG. 6. This container, for example of plastics rather than insulatingly-coated aluminium as in FIG. 5 (the coating is at 40), has its inner and outer piston connected by a flexible electrical connection 39 between conductive studs 37, 38 as shown. It connects with a centrally disposed conductive connection on the nose of the generator (not shown), provided instead of the spring contact 27. Alternatively pistons in telescopic, conducting, engagement with each other after the lubricant has been put in place may be used.

We claim:

1. An electrostatic spray gun comprising a housing for receiving a replaceable fluid container, a nozzle from which fluid is to be sprayed, means for expelling fluid from the container, and a high voltage generator for applying electrostatic potential to the fluid-to form an electrically charged atomized spray at the nozzle, wherein an electrical path from the generator to the nozzle passes through the fluid, entering the fluid prior to its emergence from the nozzle, conveniently via the wall of the container, and wherein the container is rigid and fluid is expelled from the container by a piston, under pressure exerted thereon through a forward part of the generator.

2. A gun as in claim 1 wherein in operation the container is drawn back towards the generator to commence spraying, the movement opening a valve for passage of fluid from the nozzle.

3. A gun as in claim 1, wherein loading of the container into the gun simultaneously makes connection to the electrical path from the generator and places the container in a position where a short further movement opening a valve for passage of fluid from the nozzle.

4. A gun according to claim 1 wherein pressure is applied to the container to expel the fluid by a handgrip acting through the intermediary of a variably pretensionable spring, the force necessary to overcome the pretension determining the minimum force that has to be exerted to actuate the handgrip and thus determining.

5. A gun according to claim 1 wherein the container is wholly insulating, electrical connection to the fluid being through the piston.

6. A gun according to claim 1 wherein pressure is applied to the container to expel the fluid by a handgrip acting through the intermediary of a variably pretensionable spring, the force necessary to overcome the pretension determining the minimum force that has to be exerted to actuate the handgrip and thus determining.

7. A gun as in claim 6 wherein in operation the container is drawn back towards the generator to commence spraying, the movement opening a valve for passage of fluid from the nozzle.

8. A gun as in claim 6 wherein loading of the container into the gun simultaneously makes connection to the electrical path from the generator and places the container in a position where a short further movement opening a valve for passage of fluid from the nozzle.

9. A gun according to claim 6 wherein pressure is applied to the container to expel the fluid by a handgrip acting through the intermediary of a variably pretensionable spring, the force necessary to overcome the pretension determining the minimum force that has to be exerted to actuate the handgrip and thus determining.

10. A gun as in claim 1 wherein the container is at least externally insulating and the electrical path from the generator to the nozzle passes through the fluid, entering it at a point remote from the nozzle.

* * * * *